United States Patent [19]

Bellocci et al.

[11] Patent Number: 4,506,723

[45] Date of Patent: Mar. 26, 1985

[54] TUBULAR DIE FOR THE CONTINUOUS CASTING OF A THIN-WALLED TUBE

[75] Inventors: Rio Bellocci; Yves Gourmel; Michel Pierrel, all of Pont-á-Mousson, France

[73] Assignee: Pont a Mousson S.A., Nancy, France

[21] Appl. No.: 468,739

[22] Filed: Feb. 22, 1983

[30] Foreign Application Priority Data

Mar. 12, 1982 [FR] France ..... 82 04195

[51] Int. Cl.[3] ..... B22D 11/00; B22D 11/04

[52] U.S. Cl. ..... 164/421; 164/465

[58] Field of Search ..... 164/421, 422, 464, 465, 164/418

[56] References Cited

U.S. PATENT DOCUMENTS 4,236,571 12/1980 Pierrel et al. ..... 164/421 X

*Primary Examiner*—Nicholas P. Godici
*Assistant Examiner*—J. Reed Batten, Jr.
*Attorney, Agent, or Firm*—Sughrue, Mion, Zinn, Macpeak and Seas

[57] ABSTRACT

The die (6) comprises a thick cylindrical body (7) which is surrounded by a cooling jacket (15) clamped against the pouring basin (2) and in contact with the latter in a plane (P). The body (7) is extended in the casting orifice (4) by a composite head (17) comprising a thin inner annular lip (22), whereof the inner surface extends that of the body (7) and a ring (24) of refractory material fitted between the lip, the body and the casting orifice. The (hot) lip (22) is connected to the body (7) in the plane (P), so that the ring (24) rejoins it also in this plane and that the flow of heat ($f_1$) passing from the casting orifice to the cooling jacket must skirt around this ring.

12 Claims, 6 Drawing Figures

17
25
24 22
X
4
10
3
24
22
23
26
2
P
15
f1
f2
f2
26
15
7
6
FS
8
12
X

3
F
Fs
37
2
P
28
fs
15
fe
12
36
10
8

TUBULAR DIE FOR THE CONTINUOUS CASTING OF A THIN-WALLED TUBE

BACKGROUND OF THE INVENTION

The present invention relates to the continuous vertical top casting of a thin cast-iron tube, i.e. a tube in which the ratio of the thickness/diameter is low, less than 10%, the thickness itself not exceeding 5 mm.

More precisely, the invention relates to a tubular die for the continuous casting of a tube of this type.

According to U.S. Pat. No. 4,236,571, an installation for the continuous casting of a tube of this type comprises, below a pouring-basin provided with a lower orifice, a substantially cylindrical die which is surrounded by a cooling jacket and with a core which passes through the basin to define a tubular space for the casting of the tube, an extractor device pulling on the solidified tube step by step as it is formed.

When casting a thin-walled tube and more particularly a cast-iron tube, since the entrance to the casting space is narrow, the danger of it being obstructed by a premature partial solidification is considerable.

It has thus been proposed to provide the die with a head penetrating inside the casting orifice and thus to transfer the entrance to the tubular space to a hotter region. In certain cases, the head is a simple extension of the cylindrical body of the die. In other cases, according to a more advantageous construction, it is formed by a frustoconical projection becoming thinner in the upwards direction, which is immersed in the liquid melt inside the casting orifice.

Now it will be understood that if any obstruction of the entrance is thus virtually eliminated, there will nevertheless be formed, at certain more or less regular longitudinal intervals, corresponding to multiples of the extraction step of the solidified tube, rings of a superficial incrustation of solidified cast-iron, which are not amalgamated and not welded to the remainder of the cast-iron cast in the annular space. Although they are of slight depth, these rings may nevertheless reach half the total width of the annular space between the core and die and consequently, half the thickness of the cast tube. They thus cannot be tolerated in the production of a thin cast-iron tube of great length, since they are areas of weakness which must be eliminated by cutting up the cast tube. A total obstruction of the supply of cast-iron and an interruption of casting also occurs occasionally.

SUMMARY OF THE INVENTION

The present invention intends to eliminate these drawbacks by solving the problem of controlling the cooling of the cast-iron which has been poured and that of the construction of a modified die head, making it possible to preserve perfect homogeneity and continuity of the inner die wall between this head and the body.

This invention thus relates to a die for a continuous casting installation, which is formed by a thick cylindrical body consisting of graphite and of an extension head inside the casting orifice, this die being characterised in that the head is composite and comprises at least one thin or narrow annular lip, consisting of graphite, with an inner surface continuously extending the inner surface of the die and connected to the body, opposite the plane of contact between the basin and the cooling jacket and at least one ring of refractory material surrounding the lip and in contact with the body, which opposes the passage of heat.

The composite head of such a die offers solely a narrow passage, limited to the section of the lip, i.e. to a fraction of that of the body, for the escape of heat from the liquid cast-iron towards the cooling jacket. Moreover, the refractory ring retards this escape by extending its travel.

Preferably, the thickness of the lip is approximately one third of that of the body of the die. The lip may be very slightly frustoconical or concave externally. It may be associated with a second outer lip and with the latter may define a cavity for receiving the refractory ring.

According to another variation, the lip comprises a circumferential rib and the head comprises two rings separated by this rib.

In all cases the inner face of the die is continuous and smooth.

The following description of embodiments given as non-limiting examples and illustrated in the accompanying drawings will reveal the advantages and features of the invention.

DETAILED DESCRIPTION OF THE PREFERRED EMBODIMENTS

Figure 1:
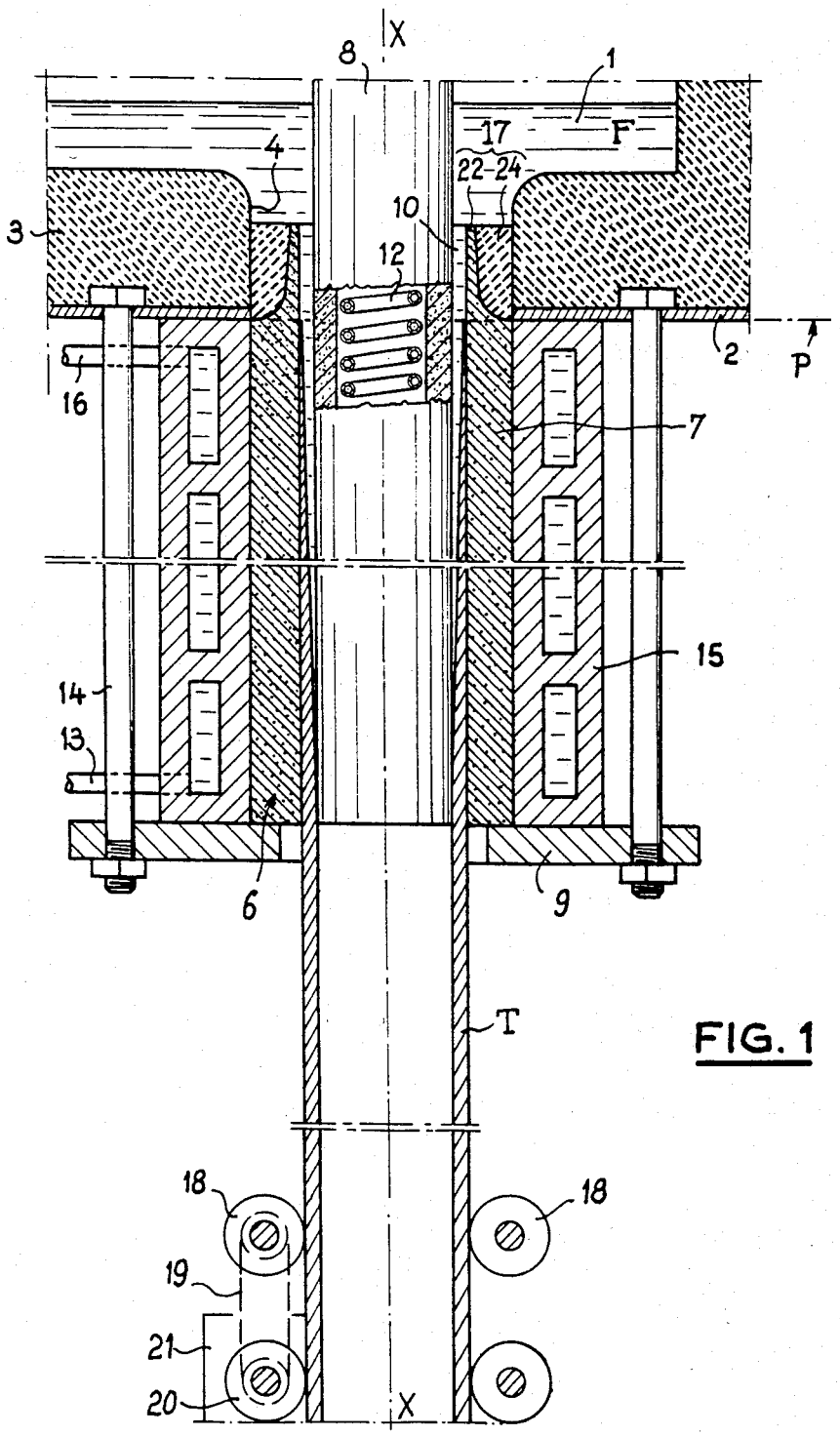
FIG. 1 is a diagrammatic sectional view of part of a continuous vertical casting installation with a tubular die according to the invention, during the casting of a tube.
Figure 2:
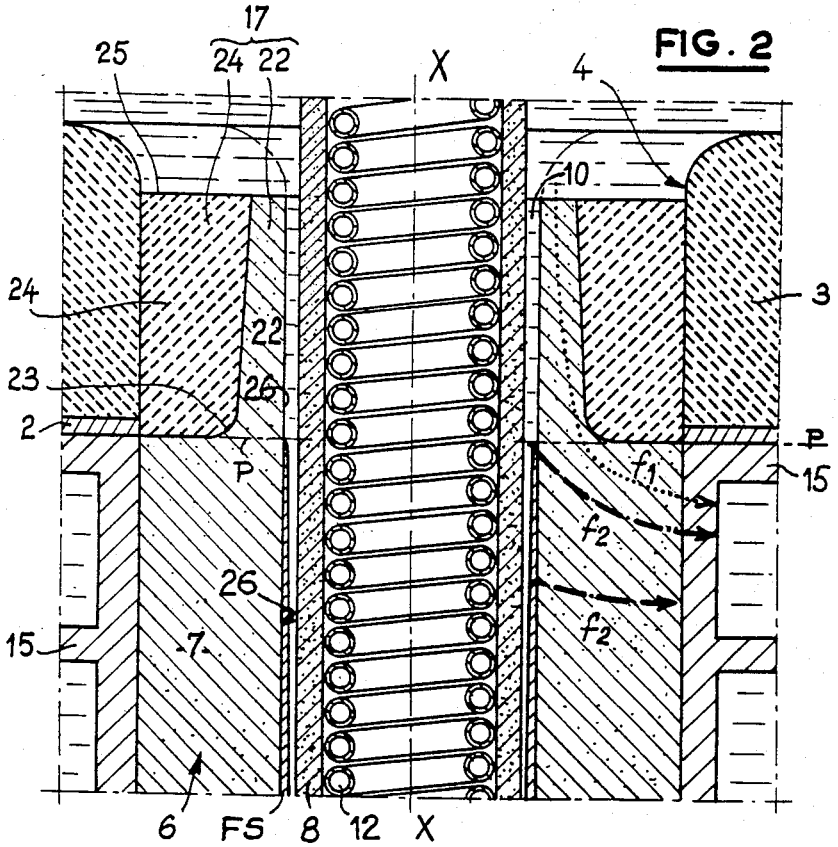
FIG. 2 is a partial diagrammatic view in section, on a scale larger than that of FIG. 1, of the die head according to the invention.

According to the embodiment of FIGS. 1 and 2, the invention is applied to an installation for the continuous vertical top casting of a thin-walled cast-iron tube T, whereof the ratio of the thickness/diameter is low, i.e. less than 10%, the thickness itself not exceeding 5 mm and possibly being of the order of 3 mm.

For the purpose of simplification, FIG. 1 shows solely part of the pouring basin 1 supplying the die of the invention with liquid cast-iron F. The pouring basin 1 is contained in a metal box or jacket 2 lined internally with a thick refractory lining 3, for example of the silico-aluminous type and in its lower part, which is the only part shown in FIG. 1, it comprises a vertical casting orifice 4, of cylindrical shape and on the axis X—X, inside which the upper end or head of the die 6 is mounted, as well as a core 8 which with this die defines a tubular casting space 10. The core 8, which is made from graphite and is arranged coaxially with respect to the casting orifice, passes through the pouring basin 1 from end to end and is suspended in its upper part, by being supported against the box 2, by known means (not shown), for example those described in the U.S. Pat. No. 4,236,571. Preferably, this core 8 is hollow and internally comprises a heating device, for example an inductor 12 in the form of a coil, consisting of copper, wound in a helix and cooled internally by water, or equally well a heating resistance.

The die 6 is also made from graphite. It is tubular and coaxial with respect to the core 8, i.e. arranged along the axis X—X and it surrounds the core 8 thus defining with the latter the narrow tubular space 10 whereof the width corresponds to the thickness of the wall of the tube T to be cast. The die 6, whereof the height is 25 cm for example for casting a tube T from cast-iron, the outer diameter of which is 170 mm and the thickness of which is 5 mm, is supported at its lower end by a flange 9 suspended from the box 2 of the pouring basin by tie-rods 14.

The flange 9 also supports a cooling jacket 15, which is coaxial with respect to the die 6 and to the core 8, which is in intimate contact with the outer wall of this die between the box 2 of the pouring basin, i.e. the outlet of the casting orifice 4 and the flange 9. This cooling jacket 15 is shown diagrammatically in the form of a sleeve for the circulation of water with inlet and outlet pipes 16 and 13 for the water, but it is clear that in accordance with the U.S. Pat. No. 4,236,571, it may comprise, between the water circulation sleeve and the die 6, a cooling jacket of liquid metal having a low melting point in order to ensure better thermal contact and consequently a perfect escape of heat.

The installation also comprises an extraction device or extractor for the cast tube T, consisting for example of two pairs of rollers 18 and 20 with horizontal axes, pressed against the outer wall of the cast tube T, symmetrically with respect to the axis X—X. Two of these rollers, located on the same side of the axis X—X, are connected by a transmission chain 19 and set in rotation, step by step, i.e. with periods of stoppage, by a speedreducer unit 21.

On account of this known extraction system, the discharge of the solidified tube T from the tubular space 10 takes place step by step.

According to the invention, the die 6 comprises a hollow cylindrical body 7 of constant wall thickness, which is extended at its upper end by a head 17 fitted in the casting orifice 4.

According to the embodiment illustrated in FIGS. 1 and 2, the composite head 17 comprises a thin or narrow annular lip 22, connected by a wide rounded portion 23 to the thick body 7, but in one piece with the latter, consisting of graphite. This connection is located exactly at the mouth of the casting orifice 4, i.e. in the plane of contact P (shown in dot dash line) between the outer face of the metal box 2 and the upper end of the cooling jacket 15. Consequently, over its entire height, the thin annular lip 22 has, inside the casting orifice 4, a thickness which is substantially less than that of the body 7 of the die 6, outside this orifice. In its upper part, the lip 22 has a thickness which is a fraction of that of the cooled part 7 of the die 6. In the embodiment illustrated, the lip 22 is frustoconical but, since its conicity is very slight, it is virtually over its entire height that its thickness is a fraction of that of the cooled body 7. By way of example, the lip 22 has a thickness at the most equal to one third of the thickness of the body 7, just before the rounded portion connecting it to this body, and an axial dimension at least equal to the thickness of the body 7 of the die and currently equal to 1.5 times this thickness.

The lip 22 is surrounded by a refractory ring 24, for example of silico-aluminous material, having good characteristics of thermal insulation. The ring 24 is fitted on the lip 22 to whose outer profile it corresponds and with this lip constitutes the composite head 17 of the die 6. The shape and width of the ring 24 enable this head to be fitted on the inner wall of the orifice 4 and thus to allow the flow of liquid cast-iron solely between the lip 22 and the core 8.

When in use, the upper end of the thin annular lip is in direct contact with the liquid cast-iron F contained in the pouring basin 1 and is connected to the thick body 7 of the die 6, just to the upper limit of the vigorous cooling of this die 6 by the cooling jacket 15.

The upper horizontal and flat edge 25 of the ring 24, which is flush with the upper end of the lip 22, is also in contact with the liquid cast-iron F of the basin 1. On the other hand, its lower edge is in contact with the cylindrical body 7 and with the rounded portion 23 connecting the lip to this body in the plane P.

From the beginning of casting and throughout the time that this lasts and consequently that the annular space 10 is filled with cast-iron, the arrangement of the composite die head 17 is thus kept in a hot region, since it is in contact with the liquid cast-iron by its upper horizontal edge and by the inner cylindrical face of the lip 22.

Cooling may come solely from the cooling jacket 15. A cooling stream passes through the conducting graphite of the lip 22 and of the body 7, but cannot pass through the refractory material of the ring 24. Consequently, the cooling streams created between the liquid cast-iron and the cooling jacket follow the paths indicated by the dotted arrowed lines $f_1$ and broken lines $f_2$ of FIG. 2.

The heat from the liquid cast-iron located above the head 17 of the die and that which is contained in the annular space 10, inside the lip 22, is directed towards the cooling jacket 11, along the dotted line $f_1$. This flow $f_1$ in fact corresponds to a small escape of heat, owing to the fact that the graphite lip 22 (coefficient of conductivity: 70 to 100 kCal/hr/m$^2$/°C.), which is thus a good heat conductor, on the one hand has a small cross-section which provides a small section of passage to the heat and on the other hand a considerable length or height which slows down the thermal flow $f_1$, accordingly, whereas the ring 24, which is made from a refractory silico-aluminous material (coefficient of conductivity: 0.5 to 3 kCal/hr/m$^2$/°C.) opposes the passage of heat and must thus be passed around.

Thus, on account of the composite head 17, or warm head, the liquid cast-iron contained in the annular space 10, inside the lip 22 and the casting orifice 4, above the plane P, is cooled relatively little. It is even possible to consider that it undergoes virtually no cooling effect.

Below the horizontal plane P which is the connecting plane of the thin graphite lip 22 and of the refractory ring 24 to the body of constant thickness of the die 7, i.e. to the part located below the upper limit of the cooling jacket 15, there are on the other hand much greater streams $f_2$ than the stream $f_1$ which carry heat from the annular space 10 to the cooling jacket 15. In fact, the section of passage provided for the heat removed from the cast-iron is much greater below the plane P, since the body 7 of the graphite die, which is a heat conductor, has a substantially greater thickness than that of the lip 22.

The real and substantial cooling of the cast-iron thus commences below this plane P, i.e. in the area of the annular space 10 which is surrounded by the cooling jacket 15 and it is solely below the plane P that the cast-iron will begin to solidify, as illustrated in FIGS. 1 and 2.

The lip 22 is not only in one piece with the body 7, but moreover its inner surface forms an exact extension of the inner cylindrical wall 26 of this body 7 (and consequently bears the same reference numeral 26), so that the die has a continuous wall over its entire height and in particular between the warm region located in the casting orifice 4, above the plane P and the region cooled by the jacket 15, below the plane P. This continuity of the graphite wall 26 presented to the liquid cast-iron is particularly advantageous, since it exists when casting begins and is maintained during the latter, when the graphite die 6 becomes heated in contact with the liquid cast-iron and consequently expands uniformly. The result of this is that the moulding walls presented to the liquid cast-iron in the annular space 10, between the lip 22 and the thick body 7 on the one hand and the core 8 on the other hand, remain continuous, which facilitates the descending flow of the cast-iron and the production of a tube T having a favourable, smooth and sound outer wall as well as a favourable inner wall.

Any obstruction of the upper part of the tubular space 10 by at least partial solidification of the cast-iron poured is thus prevented. On the contrary, solidification begins at the upper limit P of influence of the cooling jacket 15 in order to be completed at the lower end of the die 6, i.e. in the vicinity of the outlet of the latter.

Figure 6:
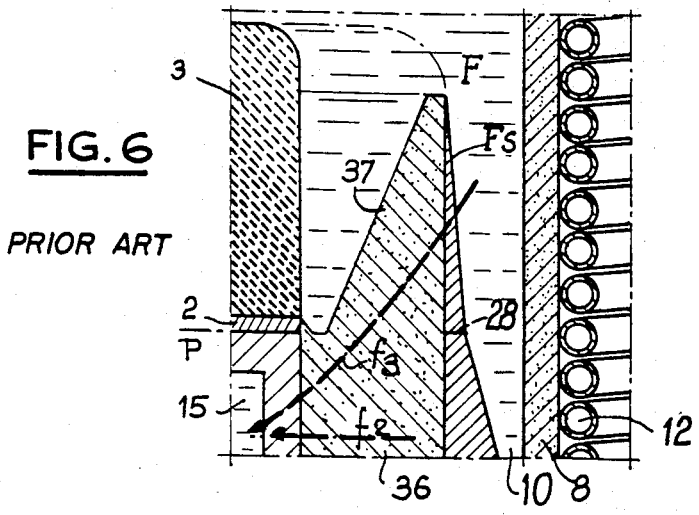
FIG. 6 PRIOR ART
FIG. 6 is a partial detailed diagrammatic view, in section, similar to FIGS. 3 to 5, showing a die head according to a known technique, by way of comparison.

The solidification front is regular and continuous. There is no longer any danger of the formation of an incrustation ring due to a discrepancy of thickness such as that shown at 28 in FIG. 6. In this figure, a die 36 of the prior art comprises a head 37 of frustoconical shape which, opposite the box 2, has the same width as the body of the die and becomes thinner in the direction of the pouring basin.

Owing to the fact that graphite is a good conductor of heat and that the section of the die head 37, above the plane P, is considerable (much greater than that of the composite head 17), the heat from the liquid cast-iron F is removed by the cooling jacket 15 through the wide section of passage provided by the die head above the plane P following a flow line $f_3$ shown in broken line. This flow $f_3$ is much greater than the flow $f_1$ in FIG. 2 since it passes through a much greater cross section of graphite. The result of this is that the solidification of the cast-iron, although slow, begins at FS above the plane P.

In the vicinity of the plane P, the thickness of solidified cast-iron FS may reach half the width of the annular space 10 and even all this space, until it becomes blocked. Below the plane P, the cooling of the liquid cast-iron is much more vigorous since the travel of the flow of heat $f_2$ towards the cooling jacket 15 is much more direct, hence much shorter.

The plane of separation P between these two cooling regions thus marks a clear variation of thickness of solidified cast-iron, which at 28 exhibits the beginning of a fracture for each extraction pass.

On the contrary, the composite head 17 of the die 6 of FIGS. 1 and 2 remains hot and prevents cooling of the cast-iron in this region of the die, so that no solidification begins above the plane P. Solidification only begins below the plane P. The serious aforementioned drawback is thus eliminated.

Furthermore, owing to its composite structure and the thickness of the refractory ring 24, the head 17 of the die is strong, is not mechanically fragile since the ring 24 protects and externally reinforces the thin lip 22 and thus ensures the continuity of thickness of the die, including in the region contained inside the casting orifice 4.

Although the embodiment of FIGS. 1 and 2 is particularly advantageous, a composite hot die head could be produced in various ways, the latter comprising on the one hand a graphite part of small section, providing a continuity of cylindrical wall for the flow of the cast-iron in the annular space 10 and providing a small section of passage for the heat in the direction of the cooling jacket 15 and on the other hand an insulating refractory part, for example of silico-aluminous material.

However, whatever the embodiment, the limit between the composite head and the body 7 of the die should remain the horizontal plane P, the body 7 having the same height as the jacket 15.

Figure 3:
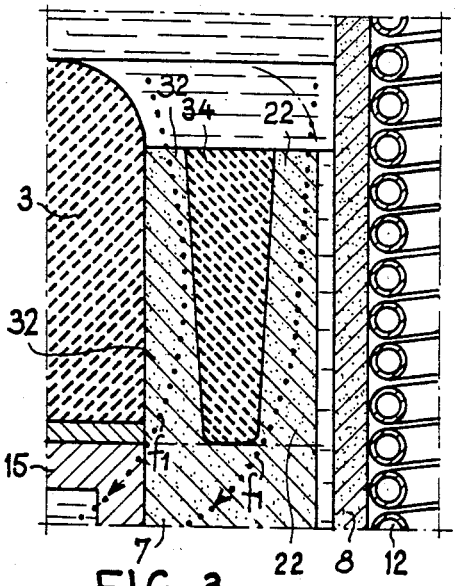
FIGS. 3,4 and 5 are partial sectional views, on the same scale as FIG. 2, of variations of die heads according to the invention.

In FIG. 3, above the plane P, the die head comprises two thin concentric annular lips, respectively an outer lip 32 and inner lip 22. The lips 22 and 32 consist of graphite since they form the continuation of the thick tubular body 7 of the die. The outer surface of the outer lip 32 is cylindrical in order to bear exactly against the wall of the casting orifice, whereas the opposing surfaces of the two lips are slightly frusto-conical and are separated by an insulating refractory ring 34, of silico-aluminous material, in close contact with each of the latter, which is naturally flush with their upper ends, along the same horizontal plane. These ends are in contact with the liquid cast-iron of the pouring basin when, as shown in full line, the refractory lining 3 is connected to the outer wall of the outer lip 32 of the composite die head. In this case, a double transfer flow $f_1$ of heat is established between the liquid cast-iron contained in the casting orifice 4 and the cooling jacket 15. These two flows $f_1$ each pass through an annular lip 32 and 22. However, in view of the fact that these lips are thin, the loss of heat through these two flows remains very low and is not able to cause the beginning of solidification of the cast-iron above the plane P, i.e. opposite the lips 22 and 32.

According to a variation, shown in dot dash line, the refractory lining is extended above the head and is connected to the inner wall of the inner lip 22.

As in the preceding embodiment, the refractory ring 34 constitutes an obstacle preventing the passage of heat whilst ensuring mechanical strengthening of the hot die head.

Figure 4:
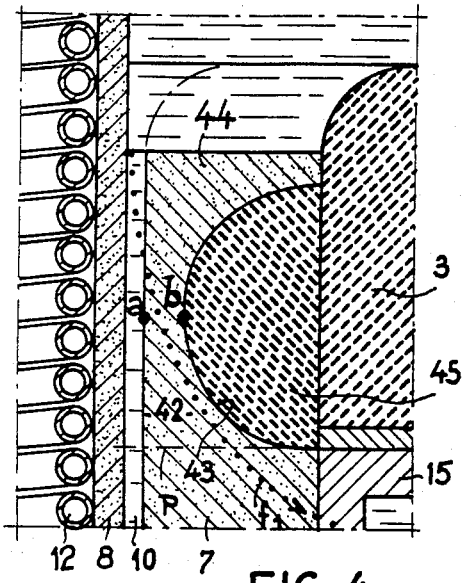

According to another embodiment illustrated in FIG. 4, above the plane P, the composite die head comprises a lip 42 whereof the outer recessed face 43 is concave according to a semi-annular recess profile, which forms a rim or upper enlargement 44 rejoining the inner wall of the casting orifice and a housing for a refractory ring of silico-aluminous material 45, with a cooperating semi-annular profile and an outer cylindrical profile adapted to the inner cylindrical profile of the casting orifice 4. The rim 44 occupies the same annular width as the body 7 located below the plane P. But this upper rim 44 of great width, in contact with the liquid cast-iron contained in the pouring basin 1, is substantially thinned down. In addition, it is reinforced and supported by the semi-annular refractory ring 45 located just below, so that the flow $f_1$ carrying heat towards the cooling jacket 15 cannot spread out over the entire annular width of this upper rim nor be guided directly towards the cooling jacket 15. On the contrary, the flow $f_1$ must skirt around the refractory ring 45 and cross a narrow annular section ab, between the refractory ring 45 and the tubular space 10. Thus, the amount of heat carried by the flow $f_1$ is small.

Figure 5:
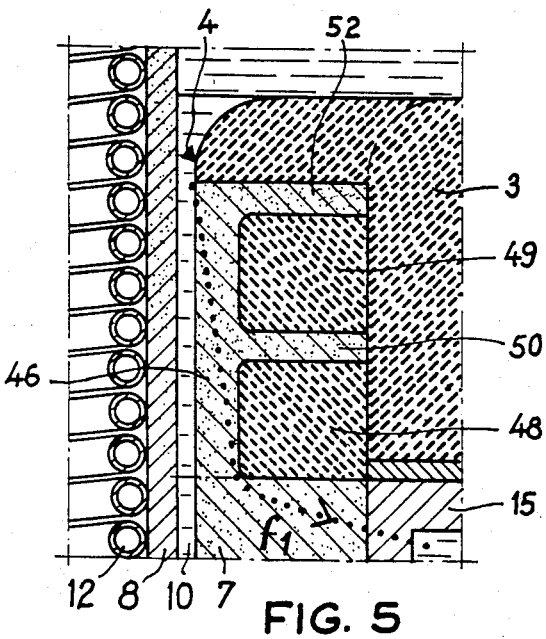

Instead of being semi-annular, the recessed outer surface of the lip and the refractory ring may have a rectangular recess profile. FIG. 5 shows an embodiment of this type. In fact, in this figure, a composite graphite head comprises a thin inner lip 46 whereof the outer recessed surface defines two housings of rectangular section, which are filled by two refractory rings 48 and 49, which are concentric and of the same cylindrical shape (rectangular or approximately rectangular profile). The two rings 48 and 49 are separated by a horizontal graphite partition 50, formed by a circumferential rib of the lip 46 in contact with the refractory lining 3 and consequently unable to provide a passage for the heat. In addition, as in the embodiment of FIG. 4, the lip 46 comprises an upper rim or flat partition 52, which gives the graphite head a meridian F-shaped profile. The upper section of this meridian F-shaped profile may be either covered with refractory lining 3, if the latter is connected by a rounded portion (shown in full line) to the inner wall of the graphite lip 46, or may be in contact with the liquid cast-iron if the rounded connection takes place along the broken line, as an extension of the peripheral edges of the partitions 50,52.

According to one variation, the lip 46 may have no upper rim 52; in its upper part, the upper insulating ring 49 is thus in contact with the lining 3, which gives the graphite lip a meridian T-shaped profile.

As in the example of FIG. 4, the section of passage offered to the flow $f_1$ for the discharge of heat towards the cooling jacket 15 remains limited to the thin vertical tubular lip 46 of the head.

Naturally, the composite head may also have other arrangements of graphite lip and ring opposing the passage of heat, depending on the installation.

In the cases where the insulating ring 45 (FIG. 4), 48,49 (FIG. 5), is not in direct contact with the cast-iron, it is advantageous to choose for this ring a material having better insulating qualities, without requiring refractory properties as necessitated by contact with the liquid cast-iron. Thus, the rings 45, 48,49 may be made from alumina fibres whereas the ring 24 may be made from silico-aluminous concrete, the latter being a much less satisfactory insulator than the alumina fibres.

In these variations, the height of a lip 32,42,46 above the plane P and its average radial width, are similar to those of the lip 22 in FIGS. 1 and 2.

Finally, although the invention has been described for continuous vertical top casting, it also relates to continuous bottom casting, the die head becoming the die "foot" and being immersed in the cast-iron bath located in the lower part of the installation. It can also be applied to continuous horizontal casting (the axis X-X being horizontal) or inclined continuous casting (the axis X-X being inclined).

We claim:

1. A tubular die arrangement for a continuous tube casting installation, comprising: a pouring basin (1) for molten metal provided with a lower outlet orifice (4), a tubular die (6) mounted to the basin and depending downwardly from the outlet orifice, a cooling jacket (15) mounted below the basin along an extension of an inner wall of the orifice, and a heated core (8) which together with the die defines a narrow tubular casting space (10) coaxial with respect to the orifice, the die comprising a thick cylindrical body (7) surrounded by the cooling jacket, and an integral head portion (17) projecting upwardly into the orifice, said head portion being composite and comprising:

(a) at least one narrow annular inner lip (22,32,42,46) of relatively high thermal conductivity material having an inner surface (26) forming a continuous extension of an inner surface (26) of the die body, said lip being joined to the die body at a plane of contact (P) between the basin and the cooling jacket, and (b) at least one insulating ring (24,34,45,48,49) of relatively low thermal conductivity material surrounding the lip and in direct contact with the body, said composite head portion constituting a relatively high resistance heat transfer path from the basin to the cooling jacket, whereby said lip is maintained at a relatively high temperature to thereby prevent premature molten metal solidification and obstruction of an entrance portion of said casting space.

2. Die arrangement according to claim 1, wherein the lip consists of graphite.

3. Die arrangement according to claims 1 or 2, wherein the lip (22,32) is very slightly frustoconical and is joined to the body by a rounded portion.

4. Die arrangement according to claim 2, wherein the ring consists of refractory material.

5. Die arrangement according to claim 4, wherein the insulating ring (24,34) fills a space between the lip (22,42) and the inner wall of the orifice, and is flush with an upper end of the lip.

6. Die arrangement according to claim 4, wherein the head portion comprises a second outer lip (32) coaxial with respect to the inner lip (22), separated therefrom by an annular space, externally cylindrical, and bearing against the inner wall of the orifice, the refractory ring (34) filling the space between the two lips.

7. Die arrangement according to claim 1, wherein the lip (42,46) comprises an upper rim (44,52) and is recessed externally by at least one annular cavity for housing the insulating ring (45,48,49).

8. Die arrangement according to claim 7, wherein the recessed outer surface (43) of the lip (42) is concave and semi-annular.

9. Die arrangement according to claim 7, wherein the lip (46) comprises a lateral rib (50) forming a partition defining and separating two cavities, and wherein two superimposed concentric insulating rings (48,49) are disposed in said cavities.

10. Die arrangement according to claim 1, wherein the radial width of the lip (22,42,46) is approximately one third that of the die body.

11. Die arrangement according to claim 10, wherein the ring (48,49) consists of alumina fibres.

12. Die arrangement according to claim 10, wherein the lip (22,32,42,46) has an axial height at least equal to the thickness of the die body.

* * * * *